United States Patent [19]

Sullivan

[11] 4,253,492

[45] Mar. 3, 1981

[54] SYSTEM FOR CONTROLLING THE FLOW OF GASEOUS FLUIDS

[75] Inventor: Robert P. Sullivan, Chattanooga, Tenn.

[73] Assignee: Combustion Engineering, Inc., Windsor, Conn.

[21] Appl. No.: 41,040

[22] Filed: May 21, 1979

[51] Int. Cl.[3] ..... F23L 13/08

[52] U.S. Cl. ..... 137/601; 98/121 A; 138/172; 138/DIG. 4

[58] Field of Search ..... 98/40 R, 40 V, 40 VM, 98/41 R, 106, 107, 108, 110, 114; 137/601; 138/172, DIG. 4

[56] References Cited

U.S. PATENT DOCUMENTS

| | | | |
|---|---|---|---|
| Re. 30,204 | 2/1980 | Root | 137/601 X |
| 941,367 | 11/1909 | House | 98/114 |
| 2,811,094 | 10/1957 | Auer | 98/108 X |
| 3,202,184 | 8/1965 | Godshalk | 138/172 |
| 3,275,031 | 9/1966 | Alyea | 137/601 |
| 3,547,152 | 12/1970 | Hess | 137/601 |
| 3,771,559 | 11/1973 | Alley | 137/601 |
| 3,972,348 | 8/1976 | Hagar | 137/601 |

*Primary Examiner*—Robert G. Nilson
*Attorney, Agent, or Firm*—Arthur L. Wade

[57] ABSTRACT

A duct, presumably that of a utility boiler or the like, has a frame mounted on its internal walls. Parallel louver blades are mounted in the frame and linked for simultaneous actuation to move the louver-blades between a first position where they seal the frame opening against the flow of gaseous fluid and a second position where they permit the relatively free flow of gaseous fluid through the frame. Bearings for the louver shafts are mounted external the duct in which the frame is mounted and a truss is attached to the upstream and downstream edges of the frame to insure dimensional stability under the stress applied to the duct by the varying pressure and temperature of the gaseous fluid passing through the duct.

4 Claims, 7 Drawing Figures

SYSTEM FOR CONTROLLING THE FLOW OF GASEOUS FLUIDS

BACKGROUND OF THE INVENTION

1. Field of the Invention

The present invention relates to moveable control elements mounted in ducts for the regulation of the rate of flow of gaseous fluid through the ducts. More particularly, the invention relates to control members in the form of louver-blades which are rotated from their ends in shutter-like configurations mounted in ducts to control the rate of flow of gaseous fluid through the ducts.

2. Description of the Prior Art

The utility boiler represents a class of industrial equipment which uses extremely large volumes of gaseous fluids. The term gaseous fluids includes both the combustion air flowed to the burners of utility boilers and the gaseous products of combustion flowing from the boilers. It is not necessary to refer to specific rates of flow to emphasize the large quantity of these gaseous fluids needing control as they flow to and from the multi-story utility boilers. It is sufficient to point out that the gaseous fluid through these ducts will range in pressure up to 60 w.g. at temperatures up to 800° F. The ducts, in cross section, will convey these gaseous fluids with cross sectional areas up to about 700 sq. ft. Prior workers in the art have long attempted to solve the problem of control of gaseous fluids in ducts ranging up to the foregoing size. The thermal and pressure forces of gaseous fluids to and from the utility boilers cycle over ranges which place large stress upon the ducts with which these gaseous fluids are conveyed. Certainly the prior art has directed efforts to controlling the "ballooning" of the duct sides under the pressure and temperature stresses. The dimensions of the ducts may bounce up and down with thermal and pressure variation, but certainly elements placed in the ducts to control the gaseous fluid flowing in the ducts must have close tolerances to have any accuracy in regulating the gaseous fluids flowing through the ducts.

The prior art has developed within the concepts of frames mounted within the ducts and various forms of moveable control elements, such as dampers, to regulate the sizes of resulting openings through the frames to establish the amount of gaseous fluid flowing through the ducts. The prior art has not solved the problem of successfully resisting the stresses placed upon the frames and dampers which change their dimensions. As the demand for greater sizes of ducts has appeared, the crude arrangements of the prior art have fallen short in efficiently providing the dimensional stability required for accurate control of the gaseous fluid passing through the duct.

Not only has the prior art failed to produce a sufficiently sturdy frame, but the louvers mounted in the frame have been cumbersome devices which have been difficult to fabricate to various sizes and maintain dimensional stability relative to the frame. Additionally, the prior art has failed to solve the problem of arranging the frame and damper mating surfaces to eliminate obstructions upon which debris accumulates.

SUMMARY OF THE INVENTION

The present invention contemplates a four-sided frame mounted on the internal walls of a duct of rectangular cross-sectional configuration. The side members of the frame are formed of elongated structures of cross-sectional channel-like configuration oriented with the back of these channels forming the internal surface of the frame to cooperate with moveable elements mounted as fluid control elements within the frame opening.

The invention further contemplates a truss structure connected to the edges of the frame at spaced stations along the edges to provide resistance to stress placed upon the frame.

The invention further contemplates mounting bearing structure external the frame and duct in which the frame is mounted for receiving the shaft ends of the louver-blades which are mounted within the frame as a moveable control element to the flow of gaseous fluid through the duct.

The invention further contemplates a louver-blade construction comprised of a central flat plate as a web with like shells attached to each side of the web plate to complete the body configuration of the louver.

The invention further contemplates first seal plates attached to the edges of the louver shells to engage the inside surfaces of the frame and second seal plates on adjacent louvers to control the flow of gaseous fluid through the frame.

Other objects, advantages and features of the invention will become apparent to one skilled in the art upon consideration of the written specification, appended claims, and accompanying drawings.

DESCRIPTION OF THE PREFERRED EMBODIMENT

The structure embodying the present invention is really quite simple. The difficulty in disclosing the invention lies in the development of terms which are logical and the use of these terms consistently in the combination necessary for a complete disclosure.

Definitions

"Duct" shall mean the large conduit which is usually fabricated of sheet metal through which gaseous fluid is moved toward or away from a source such as a utility boiler.

"Frame" shall mean the unitary structure mounted on the inside walls of a duct as a dimensionally stable static structure with which a moveable element cooperates to control the flow of gaseous fluid through the duct to which the frame is attached.

"Channel" shall mean an elongated member formed of plate-like material to have a back section from which depend leg sections at right angles to the back section.

"Blade" or "louver" shall mean the elongated body extended across the opening of the frame to be rotated on its longitudinal axis between a first position in which the body seals to the frame opening and a second position which permits a predetermined amount of gaseous fluid to flow through the opening.

"Truss" shall mean a combination of linear bracing members which may be extended over the opening of the frame, being attached to the frame in triangular patterns formed by the linear bracing members and the frame sides.

"Web" shall mean the flat plate forming the central base of the blade or louver, upon whose two surfaces are mounted like shells to complete the configuration of the blade, or louver.

Figure 1:
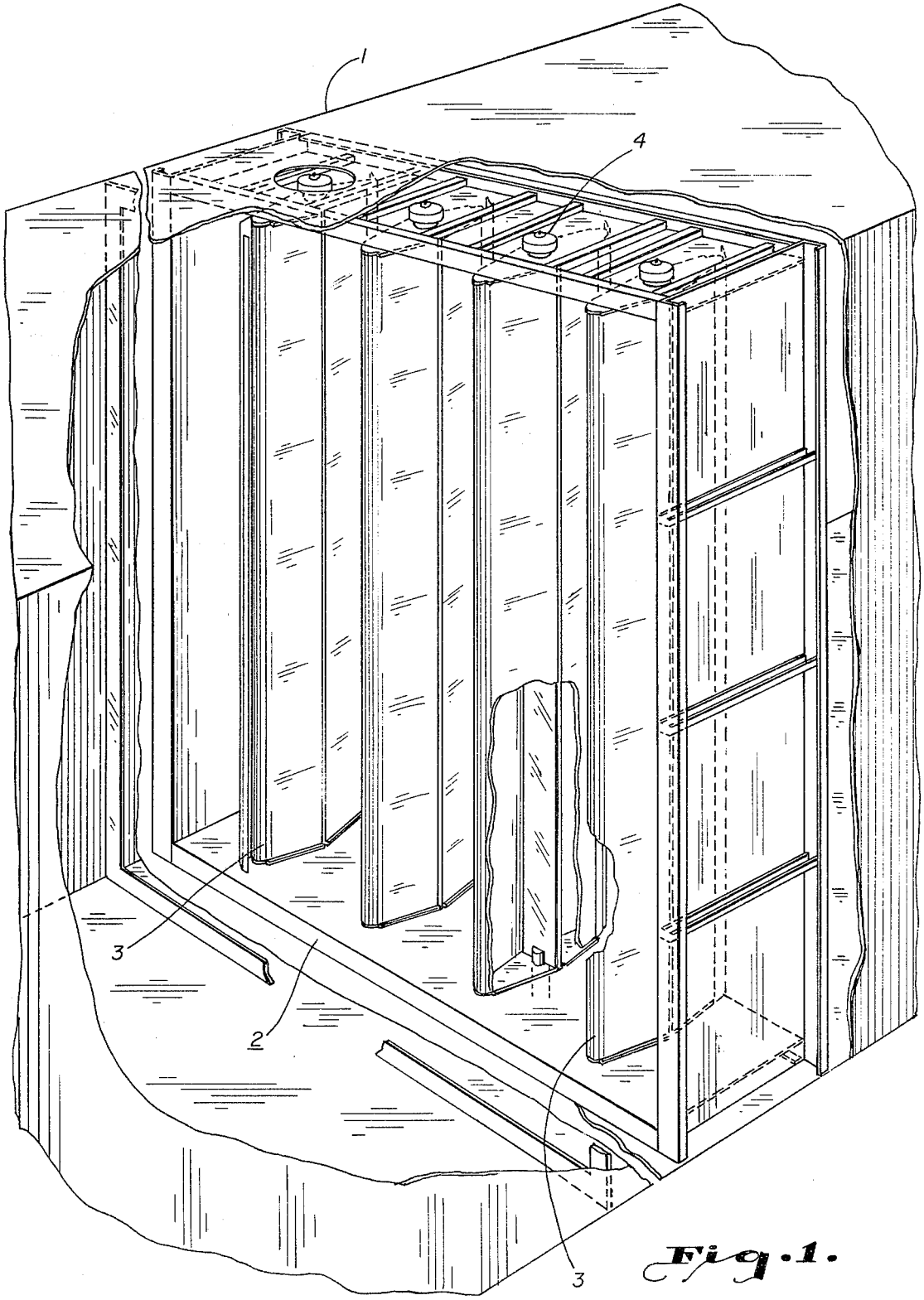
FIG. 1 is a partially sectioned perspective elevation of a duct with a frame and its louvers mounted on the internal walls of the duct and embodying the present invention.

Generalizations Relative to FIG. 1

Referring to FIG. 1, only a portion of a duct 1 is disclosed with a frame 2 mounted on its internal walls. The duct 1 is to be taken as part of the system that conveys huge quantities of gaseous fluid to and from industrial units such as multi-storied utility boilers. No purpose would be served in disclosing the present invention by depicting portions of the boiler itself. The invention is embodied around the frame 2 as the frame is mounted as shown in FIG. 1.

Duct 1 may be considered as coming in various cross-sectional sizes and lengths. It should be appreciated that the present invention contemplates application to ducts which presently measure up to 26′ by 30′.

It is quite common in this art to construct duct 1 of sheet metal. These relatively thin sheets are reinforced in various ways against stress placed upon them. The stress developed on these duct surfaces is generated by thermal and pressure cycles of the gaseous fluids flowing through the ducts. It is apparent that despite all practical, reinforcing, of stress-opposing, structure provided, the sides of the ducts are going to "balloon", buckle, or distort to some degree. The displacement, or distortion, of the sides of the ducts may not impair their general function of conducting gaseous fluid. It is readily conceivable that any valve mechanism mounted within the ducts cannot be subjected to the same order of distortion and remain in satisfactory working order. Any valve, or restrictive device, spanning the cross-section of the ducts must have fairly small clearances to efficiently seal against gaseous fluid passage. At the same time, relatively small distortion will cause the moveable parts of the mechanism to bind, or jam, resulting in the mechanism becoming inoperative.

The present invention is conceived to stabilize the function of the gaseous flow control through duct 1. The term, dimensional stability, will be used in this disclosure as a frequently recurring key phrase. The valve mechanism in which the invention is embodied has a stationary element. A moveable element is provided to seal the stationary element and prevent the passage of gaseous fluid through duct 1. The moveable element is then positioned over a range of movement which varies the amount of gaseous fluid allowed to pass along duct 1. Obviously, at least to those skilled in the art, the dimensions of the stationary and moveable elements must be stable in order for their cooperation to be consistent in carrying out flow control.

In the present embodiment of the invention, the stationary element in which invention is embodied is represented by frame 2. Frame 2 is mounted on the internal walls of duct 1. When the opening of frame 2 is sealed by a moveable element, no fluid passes. When the moveable element is positioned to provide a portion of the opening of frame 2 available, gaseous fluid passes through duct 1. The first concern of the embodiment disclosed is the construction of frame 2 with a strength which will successfully resist the forces applied by duct 1 and the gaseous fluid through duct 1.

It is regarded as practical to consider duct 1 as having a rectangular cross-section. Therefore, frame 2 will be basically formed of four longitudinal elements which themselves form a rectangle and are sealed to the internal sides of duct 1 as a mounting. The formation of each side of frame 2 will be disclosed subsequently. In general, each side has a cross-sectional shape of channel-like configuration. Each channel back is oriented inwardly in order to provide smooth internal frame surfaces to which the moveable element will seal. The cross-section of channel-like configuration is inherently rugged. Additionally, dimensional stability of the frame is reinforced by attaching a truss structure to each upstream and downstream edge of frame 2. Further details of this truss structure will be disclosed subsequently.

The moveable element cooperating with frame 2 is embodied in louvers 3. Essentially, a set of these louvers 3 may be termed shutter-like. For the moment, consider each louver as a flat blade and all blades extending through apertures in parallel sides of frame 2. If the blades are rotated along their longitudinal axis, they will function as a shutter structure, resembling the familiar venetian blind.

Each louver, or blade, has a shaft on each end which extends through apertures in the sides of frame 2 and are journaled in bearings 4 mounted to be accessible from outside of duct 1. It should be obvious now that bearings mounted to be accessible from the outside of duct 1 will be significantly free of dirt and debris carried by the gaseous fluid within duct 1.

Construction of each louver, or blade 3, embodies invention. The internal construction of the blade includes inventive concept. Seal surfaces are provided with inventive concepts on the active edges of each louver, the surfaces of these seal elements engaging the internal surfaces of frame 1 and the seal surfaces of companion blades.

Disclosure of FIG. 1 lays the foundation for demonstrating unique construction in frame 2 to give the frame dimensional stability. The strength to provide this stability comes from the inherent form of the frame members and the truss structure connected to spaced stations along the frame edges. Further, the width of the frame is provided wide enough to accommodate the moveable elements in the form of louvers, leaving the edges as anchoring structure for the strengthening truss. Finally, the frame provides a smooth internal surface which will be purged of debris by the gaseous fluid passing through the duct, leaving the frame surface available to efficiently engage the seal elements of the louvers.

The louvers, as active, moveable elements mounted within the frame, have unique features in their own right. Inventive concepts embodied within the louvers give them inherent strength and make construction of various widths easy and economical. When all the inventive concepts are disclosed, what appears to be a staid, unglamorous piece of hardware for the simple function of fluid flow control in a duct becomes anything but drab machinery among the myriad industrial fixtures necessary to the function of the modern power plant.

FIG. 1 was not designed to disclose the details of each of the frame 2 side members. The thrust of the visual stimulation of FIG. 1 was to advance the concept of the rectangular shape of the frame and the parallel louver-blades mounted with their shafts through parallel sides of the frame. The overall effect is, in FIG. 1, of a shutter-like damper structure spanning the opening through frame 2. The mysteries of the frame strength are revealed in subsequent figures.

Figure 2:
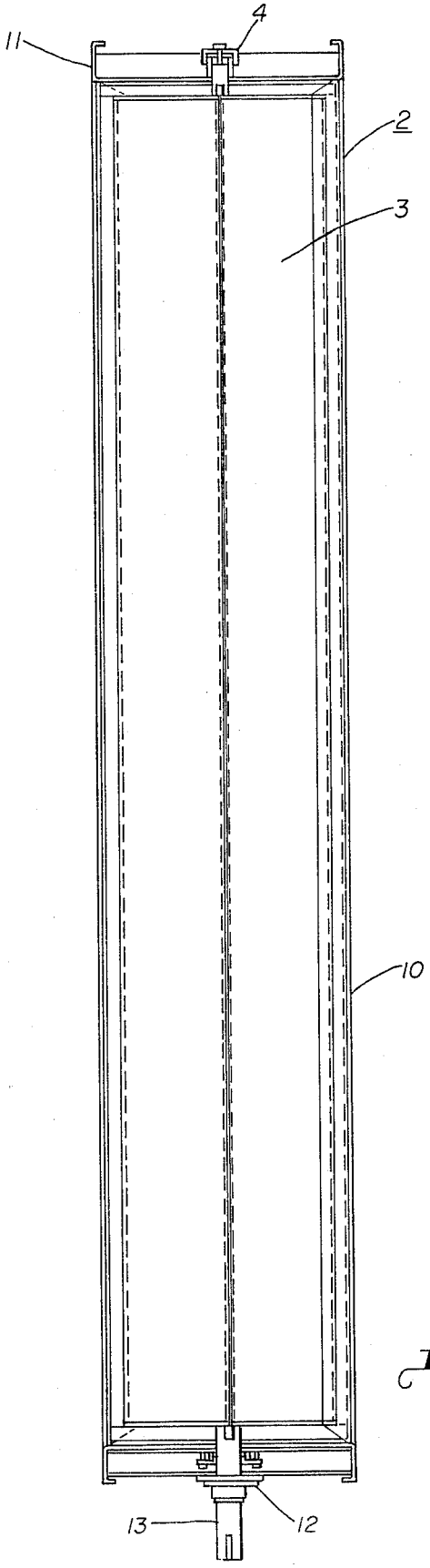
FIG. 2 is a side elevation of the frame of FIG. 1 disclosing one of the louver-blades mounted therein.
Figure 3:
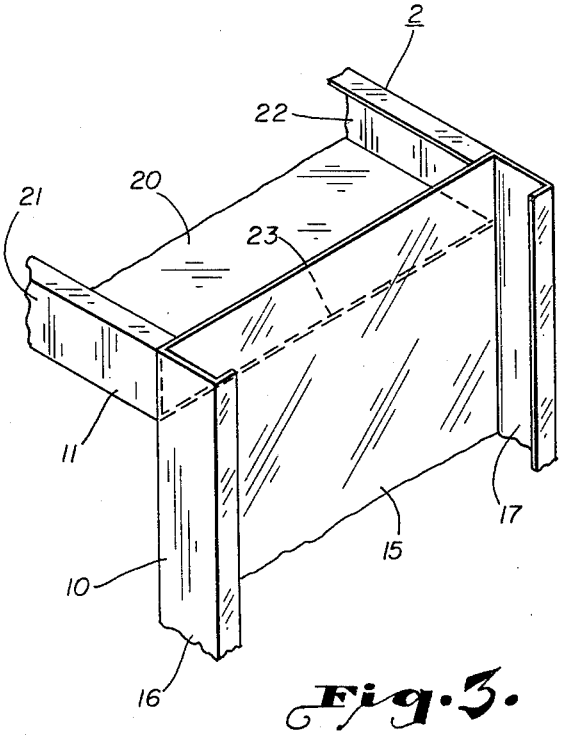
FIG. 3 is a perspective of a corner of the frame.

Frame Detail in FIG. 2 and FIG. 3

The basic visual message in FIGS. 2 and 3 is the channel configuration of each frame side. FIG. 2 discloses frame 2 in a side elevation. The frame is shown as removed from duct 1 in order to expose the louver-blade 3 which is mounted at that end of frame 2.

To maintain a logical system of designation, frame 2 is said to disclose its side 10 to view in FIG. 2. The top, adjacent and connected, side 11 is designated in FIG. 2. The corner, at which these frame sides 10 and 11 are joined, is disclosed in FIG. 3.

For the first time, the bearing for louver-blade 3 at the bottom of frame 2 is disclosed at 12. The shaft 13 of the louver-blade 3 is journaled through bearing 12. The shaft 13 will be connected with actuating linkage not shown in order to rotate louver-blade 3 about the axis of shaft 13.

A final teaching of FIG. 2 is the relation between the width of frame 2 and louver-blade 3. It is readily discerned that the blade width is less than that of the frame 2. Therefore, a strengthening truss can be readily attached to the upstream and downstream sides of frame 2 without interfering with the travel of the louver-blade tips.

Shifting attention to FIG. 3, emphasis is found in the channel-like structure of frame sides 10 and 11. Of course, each of the four frame sides is represented in this channel characteristic by sides 10 and 11 in FIG. 3.

A channel shape is a common technique for providing plate-like members with structural strength. Essentially, a channel-shape structure has a back and a leg at each edge depending at a right angle from the back. FIG. 3 discloses that the frame sides 10 and 11 each have this channel-like configuration.

Frame side 10 is a channel with back 15 having leg 16 and leg 17, each turned at a right angle to the plane of back 15. Legs 16 and 17 each have a channel-like cross section in their own right which is left to direct observation of FIG. 3. For the purpose of the present disclosure, frame side 10 is spoken of as having a back 15 with legs 16 and 17. The same connection holds for frame side 11.

Side 11 is comprised of back 20 with legs 21 and 22. Regarding their basic channel-like configuration, frame sides 10 and 11 draw upon their first inherent strength found in this channel-like configuration.

In FIG. 3, the ends of frame sides 10 and 11 are joined by abutting one channel to the other. The backs 15 and 20 are brought together at a line 23. The legs of the abutted channels then form the corner which fits snugly into duct 1. Precisely how additional fastening structures will join the frame sides to the duct sides is a detail which need not be disclosed. What FIG. 1 indicates and FIG. 3 confirms is the simple basic strength of frame 2 which is drawn from channel-like configurations of the sides of the frame. Finally, FIG. 3 specifically discloses how these sides of the frame are joined to each other at the four corners of the frame in order to fit into the internal walls of duct 1.

Obviously, there is nothing inherently new in using channel cross-sections for construction. However, no worker in the prior art has conceived of this plenary use of the channel construction for a frame mounted on the internal sides of duct 1.

The details of fitting the ends of the frame sides together with abutting joints and welded joinings is shown in detail. These are the obvious details underlying the basic concept of utilizing channel construction for frame 2 to obtain a dimensional stability under stress.

The secondary considerations of FIG. 1 are the openings through parallel frame sides to accommodate the shafts of the louver-blades. As a carry-over from FIG. 1, it is emphasized that these blades 3 extend their shafts through the frame side members to journal in bearings 4 and 12 which are mounted to be accessible from external duct 1. Bearings 4 and 12 in such positions are isolated from the dirt and debris within duct 1 and can be readily lubricated, repaired and replaced as service requires.

Figure 4:
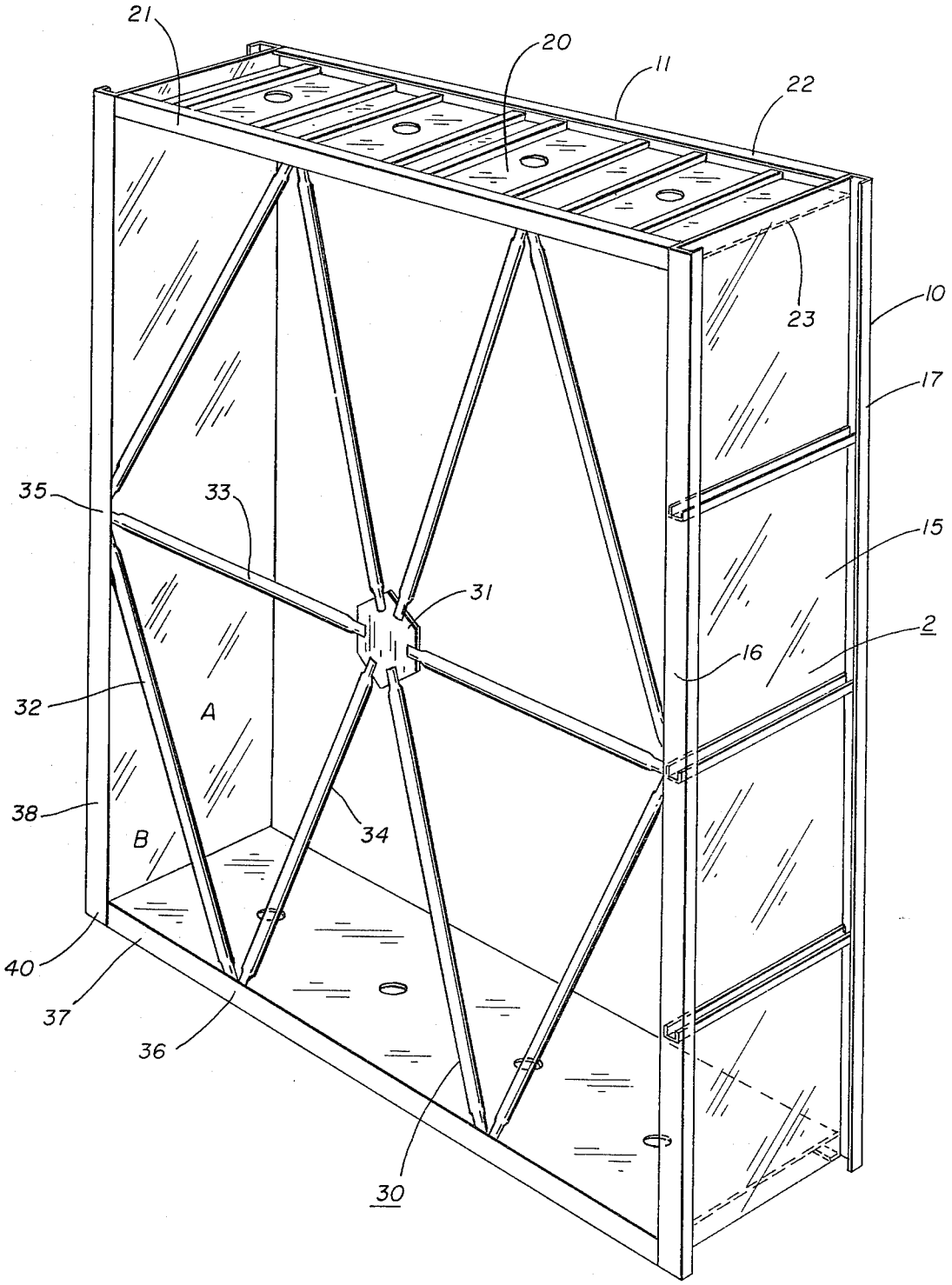
FIG. 4 is a perspective of the frame with a truss mounted on one side.

The Frame Truss of FIG. 4

FIG. 4 is established to disclose truss 30 as it is attached to one side of frame 2. A similar truss can be connected to the opposite side of frame 2. However, the second truss is not disclosed as it would unnecessarily complicate FIG. 4.

Frame 2 is not shown with its damper structure mounted therein. The louver-blades of the damper structure, as well as the bearings and actuators, would also be an unnecessary complication in FIG. 4. FIG. 4 is established to show precisely how truss 30 is attached to the side of frame 2 to give additional resistance to the forces applied to deteriorate the dimensional stability of frame 2.

FIG. 3 is to be oriented with frame 2 as disclosed in FIG. 4. Thus, sides 10 and 11 of frame 2 are found in FIG. 4 as they join their backs 15 and 20 at line 23. Legs 16 and 21 of the sides are then one-half of a side of frame 2. It is to this side that truss 30 is connected.

Truss 30 is comprised of linear bracing members which are connected to each other and to the sides of frame 2. A center plate 31 is attached to radiating members of the truss. Certain of these bracing members will be designated in order to disclose the concept under the configuration that the members form with each other and the frame 2 side.

A key word, "triangulation", is coined to help make a complete disclosure. Broadly, triangulation means that the bracing members form triangles with each other or with each other and portions of the side which truss 30 is connected to. A more detailed analysis is desirable.

Refer to bracing members 32, 33 and 34. These bracing members form a triangle A. At the same time, triangle A connects to stations 35 and 36 on the frame side. Note linear section 37 of the frame side and linear section 38 of the frame side are joined to form corner 40. Therefore, linear member 32 and frame side sections 37 and 38 form triangle B. The result is that all of the similar linear bracing members of truss 30 form triangles comparable to A and B in their connections with each other and with the stations along the side of frame 2 to which they connect.

The triangle is the greatest strength pattern for linear elements. Triangles A and B represent how this pattern is carried out in truss 30. Of course, triangular patterns other than the specific one disclosed in FIG. 4 may be formed. Still, the concept of triangulation is to be carried out under the teachings of the invention.

Shifting to the specific construction of each of the linear bracing members, FIG. 4 shows that cylindrical pipe forms are adequate. The end of the linear member pipes are flattened and otherwise shaped for attachment to each other, plate 31, and the frame 2 side by welding. The combination of the pipe form for the linear members and the triangulation for their connections provides the ultimate resistance to stress placed upon frame 2. Therefore, the dimensional stability of the inside surface of frame 2 is preserved for engagement with the sealing members of the louver-blades.

Figure 5:
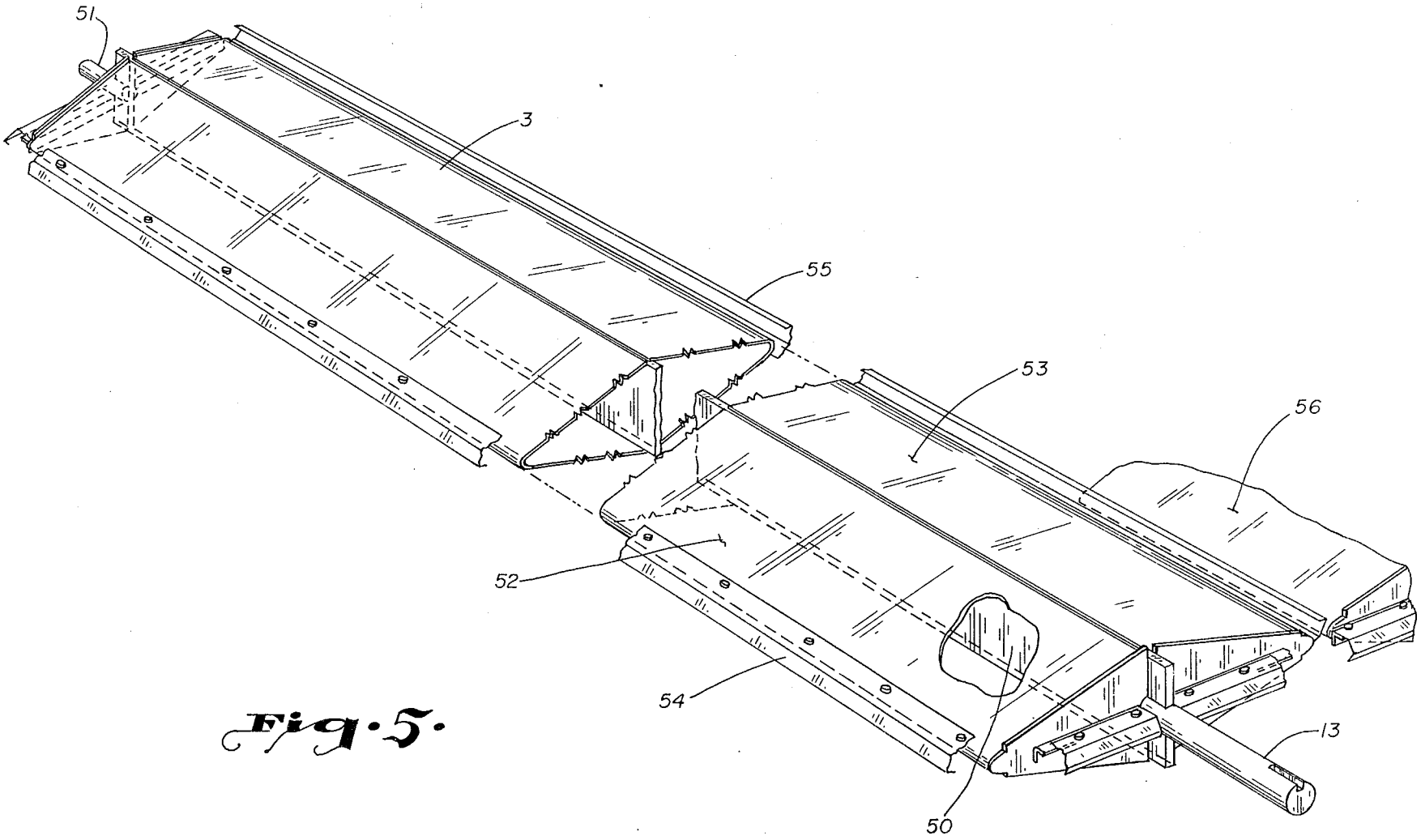
FIG. 5 is a perspective of a louver-blade.

The Louver-Blades of FIG. 5

In FIG. 5, one of the louver-blades 3 is disclosed sufficiently in sectioned isometric. All of the blades 3 are substantially the same with the exception of the seal elements at their edges. The shape of the seal for engaging the frame is somewhat different from the shape of the seal which engages the seal of a companion louver-blade.

Again, dimensional stability is given high priority. The present invention begins with the provision of central web plate 50. Plate 50, as a base for the complete structure, can be made as thick as necessary and cut to the width required for a particular damper assembly. When it is considered that the length required for these louver-blades may be up to the order of 30 feet, it can be appreciated that dimensional stability depends predominantly upon the size of web plate 50. Around web plate 50 can be constructed the equivalent of an I-beam with all of the inherent strength of that form.

Coordinating the louver-blades of FIG. 5 with the disclosure of FIGS. 1 and 2, shafts 13 and 51 are discerned as aligned with each other and attached to the ends of web plate 50. It is these shafts 13 and 51 which are journaled in the bearings mounted on the frame 2.

To complete the formation of the body of the louver-blades, shells 52 and 53 are mounted on opposite sides of web plate 50. The assembly of the web plate 50 and these shells will be further disclosed in subsequent drawings. In FIG. 5, it can be seen that the shells are formed of a member whose cross section is that of a parabola. When this shell is mounted on one of the faces of web plate 50 and welded to the edges, the web plate 50 becomes the base of the parabola. Considering a section of the shells 52 and 53 as they extend from the edges of web plate 50, there is formed the equivalent of an I-beam having the inherent strength provided by that form. The result of this combination is louver-blades 3 with a dimensional stability dependent upon the thickness of the web plate 50 and the thickness of the plate from which shells 52 and 53 are formed. A large range of dimensional flexibility is provided in that the width of the web plate 50 and the height of the shell's parabola can be readily selected in fabrication. Very minor adjustments are needed in the required jig for bending the plate of shells 52 and 53 to the height required for their parabolas mounted upon the web plate 50. In the actual reduction to practice, two different thicknesses of the shell plate have been adequate.

The ends of the shells are closed off with plate structure which will be discussed in detail. This structure is rather straight forward in providing a base for the seal structure to engage the surfaces of frame 2. It is the seal structure of the edges of the louver-blades 3 which is the more dramatic disclosure of FIG. 5.

Seal strip 54 is shaped and arranged to contact the inside surface of frame 2. Seal structure 55 is shaped and arranged to contact similar seal structure on parallel companion louver-blade 56. Although the inside of frame 2 is not disclosed in FIG. 5, a fragment of louver-blade 56 has been shown to give disclosure of the engagement between the louver-blade seals at the edges of the louver-blades. The sheet material from which the seals 54 and 55 are formed is quite thin. Compared with the thickness of the shells 52 and 53, this seal material is light indeed. The actual reduction to practice uses thicknesses in the order of 0.030 inch. As for the specific shape, that disclosed in FIG. 5 is representative of shapes needed to effectively engage the flat surface of frame 2 by seal 54 and another seal on louver-blade 56 by seal 55. Subsequent drawings will show these shapes to additional advantage.

Figure 6:
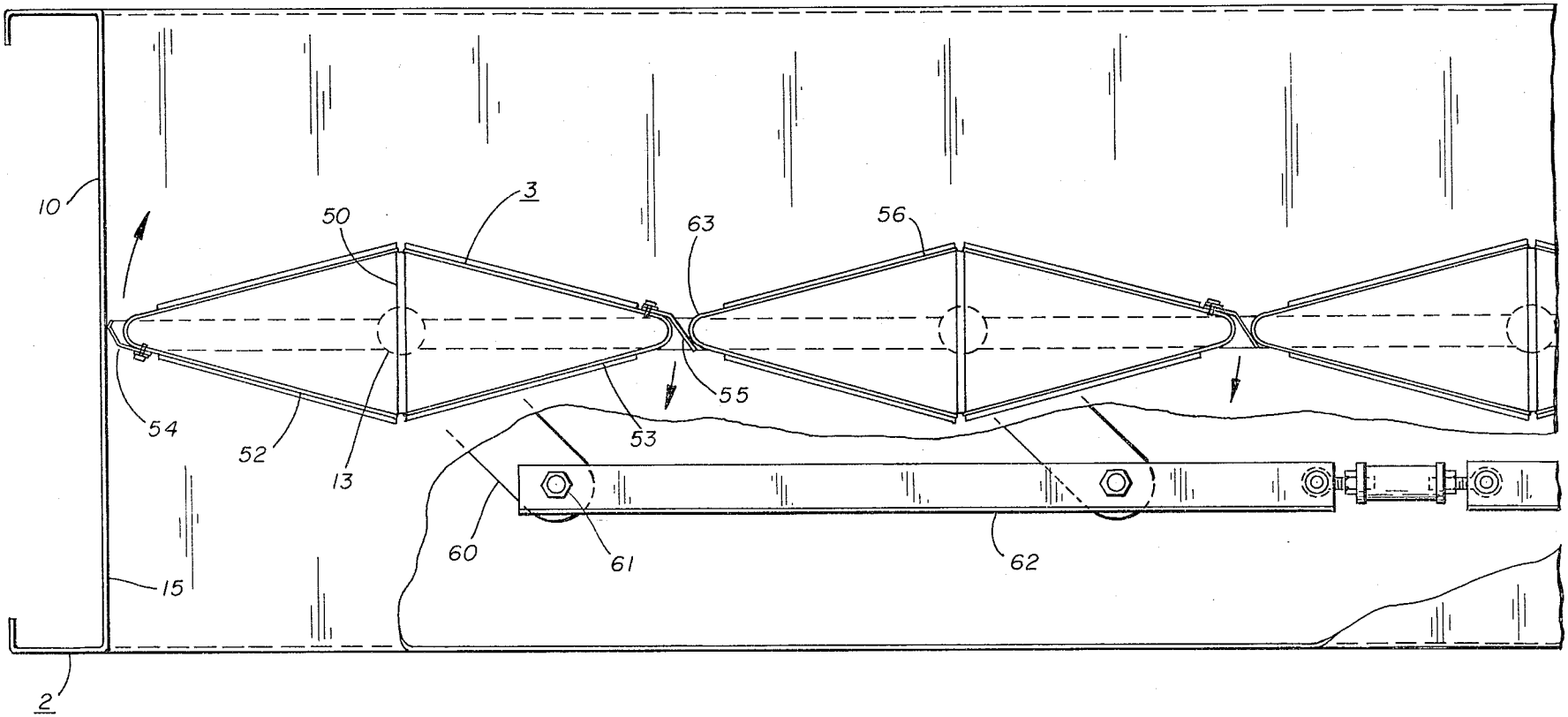
FIG. 6 is a bottom view of the frame showing the louvers actuated by linkage.

Actuating Linkage of FIG. 6

FIG. 6 discloses frame 2 from its underside. More specifically, the view of FIG. 6 is taken from below the frame as disclosed in FIG. 4 along side 10 of the frame 2. Therefore, the louver-blades 3 bring seal strip 54 against the flat surface of back 15. Admittedly, the view provided by FIG. 6 does not show much of frame 2. However, if the viewer would imagine himself oriented below duct 1 of FIG. 1 and frame 2 as shown in FIG. 2, orientation may be easy.

FIG. 6 is provided to make more clear the cooperation between louver-blades comprising the damper within frame 2. Each of the louver-blades is positioned in its sealing relationship to the frame and to each other. Previously, it has been inadequately disclosed how the simple connecting linkage between louver-blades moves them together. Beginning with louver-blade 3, it is now clear that a simple arm 60 is connected to shaft 13. The other end of arm 60 is pivotally connected at 61 to shaft 62. All of the other louver-blades are similarly connected to actuating shaft 62. When a motive means shifts shaft 62 to the left as viewed in FIG. 6, all louver-blades will be rotated about their respective shafts at the same time and move toward their second extreme position at which the louver-blades, in their widths, will be parallel to gaseous fluid through frame 2. Of course, any desired position intermediate the two extreme positions can be assumed by the damper through actuating shaft 62.

In addition to the simple teaching of linkage actuation of the louver-blades, FIG. 6 discloses with further clarity how seal strip 54 engages the smooth surface of back 15 of frame side 10. At the same time, seal plate 55 is brought into snug contact with seal plate 63 mounted on the edge of louver-blade 56. These two sealing contacts are repeated along the line of the louver-blades of the damper. With the dimensional stability provided by this trussed frame construction and the constructive I-beam configuration of the louver-blade structure, the flow of gas through frame 2 and duct 1 is accurately controlled with consistency.

Figure 7:
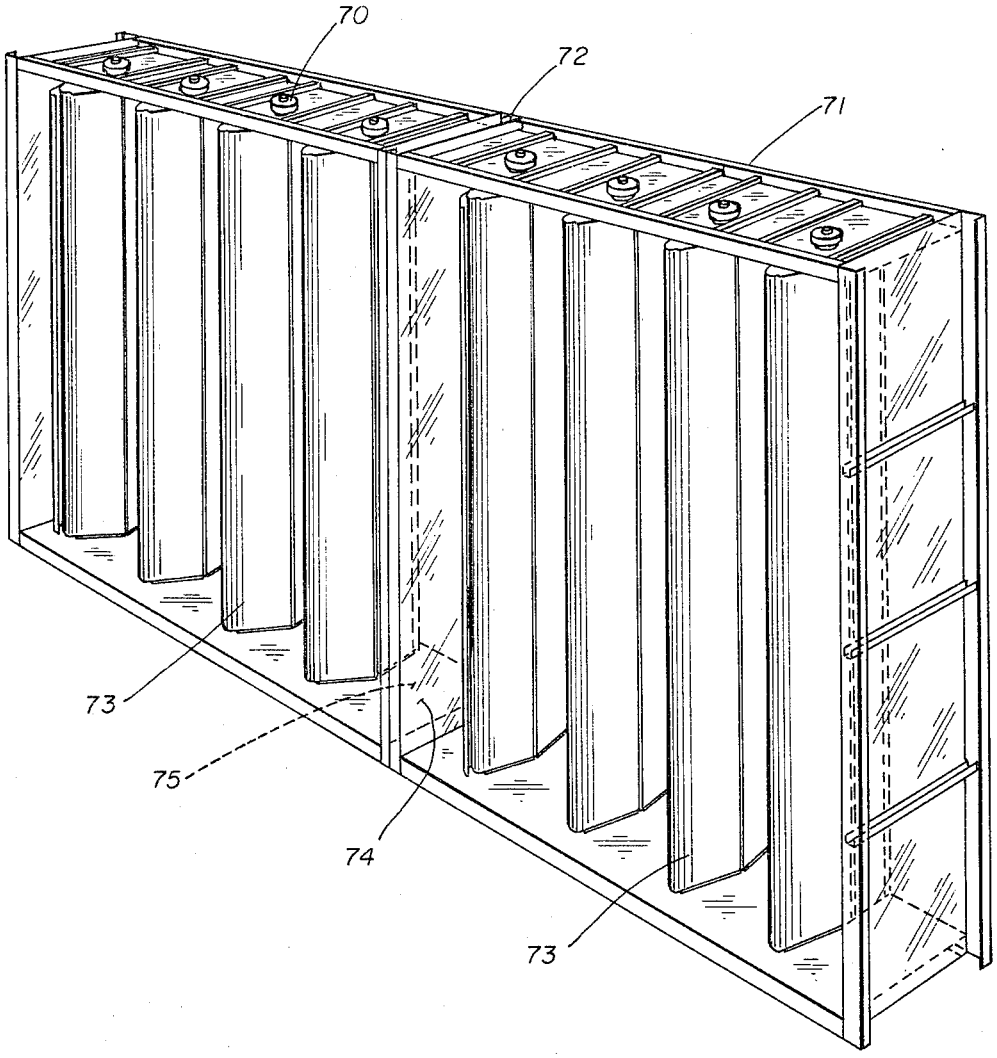
FIG. 7 is a perspective of two frames joined together for mounting in a duct.

Joined Frames of FIG. 7

FIG. 7 discloses how two or more frames may be joined together to fit inside a duct whose cross-sectional area exceeds the largest frame which can be shipped as a practical matter, the size of structures which can be transported on railway cars and other conveyances with cargo space is established. Therefore, the single frame of FIG. 1 and FIG. 4 is termed a "shipping piece". When the duct size demands a damper structure larger than the maximum required for a shipping piece, a plurality of shipping pieces can be installed. FIG. 7 discloses two shipping pieces joined together for installation in a duct.

Shipping piece 70 and shipping piece 71 are aligned to abut each other at 72. Broadly, there is little complication to this plan. A common linkage system, not shown, can rotate all shafts of dampers 73 in unison. No details are disclosed in FIG. 7 which relate to the bearings for the louver-blades or their cooperation with each other and the inside surfaces of their frames. All of these essential details have been disclosed in the preceding figures. A truss is also not shown with either frame 70 or frame 71. Trusses for each of these frames would unnecessarily complicate the drawing. It is to be understood that trusses may be provided as disclosed in FIG. 4.

The basic teaching of FIG. 7 is the limitation on shipping piece size, dictating the joining of two or more frames to provide a complete damper structure of the size required for a duct.

The basic modification of the frames 70 and 71 from the frames disclosed in FIGS. 1 and 4 is in the abutting sides 74 and 75. As shown, the legs of these abutting side channels are shortened so that together they offer no more obstruction to the flow of gaseous fluid through the duct than a single channel.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

The invention having been described, what is claimed is:

1. A structure for controlling the flow of gaseous fluid through a duct with a frame and moveable element cooperating with the frame opening through which the gaseous fluid in the duct flows, including, a duct with a generally rectangular cross section, a frame of four sides mounted in a plane oriented at right angles to the duct axis and sized and arranged against the internal duct walls to provide cooperation between the frame opening and a moveable element to determine the rate of flow of gaseous fluid through the frame opening, a cross-sectional channel configuration provided for each of the four sides of the frame with the back of the channels forming the frame opening, a pair of apertures formed in alignment through two parallel sides of the frame and duct, bearing structure mounted on the frame so as to be accessible from outside the duct and in alignment with the apertures, a shaft journaled in each bearing and extending through each aperture in axial alignment toward each other, a web plate connected between the ends of the shafts to form a base for a louver structure which will rotate as the moveable element in the frame opening to control the flow of gaseous fluid through the frame opening, and a shell structure mounted to extend from each side of the plate to form the body of the louver which functions as the moveable member to control the gaseous fluid flowing through the frame opening.

2. A damper system for controlling the flow of gaseous fluid through a duct, including, a duct comprised of relatively thin sheet metal under the stress of gaseous fluid passed through the duct under pressure and with varying temperature, a frame mounted on the internal walls of the duct in a plane normal the axis of the duct and constructed with the rigidity which will maintain its dimensional stability as the internal cross-section of the duct varies in shape under thermal stress and pressure cycling of the gaseous fluid passing through the duct, a series of louver blades mounted in the frame and parallel to each other and extending shafts at their ends through apertures in the frame and the ends of the shafts being journaled in bearings mounted on the frame so as to be accessible from the outside of the duct, bearings mounted on the frame so as to be accessible from the outside of the duct and in alignment with apertures through the duct and frame to receive the shafts at the ends of the louver-blades so the louver-blades may be rotated from a first position at which they seal the frame opening in which they are mounted to a second position at which they permit ready passage of the gaseous fluid through the frame opening, and means for rotating the louver-blades together between their two positions.

3. The damper system of claim 2, including, a truss structure attached to stations spaced along the frame edge and comprised of linear bracing members connected to form triangular patterns with each other and the frame edge to which the truss structure is attached.

4. The damper system of claim 2, wherein, each of the louver-blades is characterized by a central web plate extended between shafts which are in turn journaled into the bearings, shells are mounted on each face of the web plate at the edges of the plate to form a constructive I-beam, and seal flanges are mounted on the edges of the shells to engage the inside surface of the frame and seal flanges mounted on companion louvers.

* * * * *